US009389575B2

(12) United States Patent
Korematsu

(10) Patent No.: US 9,389,575 B2
(45) Date of Patent: Jul. 12, 2016

(54) IMAGE FORMING APPARATUS

(71) Applicant: SHARP KABUSHIKI KAISHA, Osaka-shi, Osaka (JP)

(72) Inventor: Kazuya Korematsu, Osaka (JP)

(73) Assignee: SHARP KABUSHIKI KAISHA, Osaka-shi (JP)

( * ) Notice: Subject to any disclaimer, the term of this patent is extended or adjusted under 35 U.S.C. 154(b) by 0 days.

(21) Appl. No.: 14/534,324

(22) Filed: Nov. 6, 2014

(65) Prior Publication Data

US 2015/0132038 A1 May 14, 2015

(30) Foreign Application Priority Data

Nov. 11, 2013 (JP) ..... 2013-232782

(51) Int. Cl.
*G03G 21/00* (2006.01)
*G03G 15/00* (2006.01)

(52) U.S. Cl.
CPC ..... *G03G 21/0011* (2013.01); *G03G 15/75* (2013.01)

(58) Field of Classification Search
CPC ..... G03G 15/751; G03G 21/0011; G03G 21/0017
USPC ..... 399/159, 350
See application file for complete search history.

(56) References Cited

U.S. PATENT DOCUMENTS

| | | | | |
|---|---|---|---|---|
| 6,326,111 | B1 | 12/2001 | Chambers et al. | |
| 2004/0240915 | A1* | 12/2004 | Nakayama | 399/345 |
| 2013/0260295 | A1* | 10/2013 | Iwadate et al. | 430/56 |

FOREIGN PATENT DOCUMENTS

| | | |
|---|---|---|
| JP | 3186010 | 5/2001 |

* cited by examiner

*Primary Examiner* — Hoang Ngo
(74) *Attorney, Agent, or Firm* — Nixon & Vanderhye P.C.

(57) ABSTRACT

This invention relates to an image forming apparatus for preventing defects in a cleaning blade, filming on a photoreceptor and image defects, and more particularly to an image forming apparatus comprising a toner comprising an external additive, a photoreceptor containing fluororesin particles in its surface layer, and a cleaning blade for cleaning a surface of the photoreceptor, wherein a primary particle diameter of the fluororesin particles is 2.6-7.5 times as large as a primary particle diameter of the external additive.

4 Claims, 2 Drawing Sheets

IMAGE FORMING APPARATUS

CROSS-REFERENCE TO RELATED APPLICATIONS

This application claims priority to Japanese Patent Application No. 2013-232782, filed on Nov. 11, 2013, which is incorporated herein by reference.

BACKGROUND OF THE INVENTION

1. Field of the Invention

This invention relates to an electrophotographic image forming apparatus.

2. Description of the Related Art

In electrophotographic photoreceptors used for electrophotographic image forming apparatuses (hereinafter simply referred to as "photoreceptors"), fluororesin particles as filler particles are added to materials for the surfaces of photoreceptors in order to improve mechanical properties. For example, Japanese Patent No. 3186010 discloses a photoreceptor added with polytetrafluoroethylene particles as fluororesin particles.

Meanwhile, in two-component developers, etc. used for image forming apparatuses, the surfaces of toners are added with external additives composed of fine silica particles, etc. having a particle diameter of 20-500 nm for maintenance of flowability and improvement in transcription efficiency.

BRIEF SUMMARY OF THE INVENTION

However, when the photoreceptor of JP-B-3186010 is used for a prolonged period, a photoreceptor surface 80 is abraded, so that a fluororesin particle 83 can protrude the photoreceptor surface 80 and leave the photoreceptor surface 80 due to its water repellency, as shown in FIG. 4(*a*). Moreover, as shown in FIGS. 4(*b*), (*c*), a concave portion 87 formed by separation of a fluororesin particle 83 is filled with external additive(s) 95 that leave a toner, which can cause their adhesion.

In the photoreceptor, to the surface 80 of which external additive(s) 95 are adherent, the contact of a cleaning blade B with high hardness external additive(s) 95 causes defects. When the cleaning blade B is defective, residual toners go through the defective portion and the residual toners are not removed, and therefore there is a problem that causes filming on photoreceptors and image defects.

In light of the above-mentioned problem, it is an object of the invention to prevent defects in a cleaning blade, filming on a photoreceptor and image defects in an image forming apparatus comprising a photoreceptor containing fluororesin particles.

The invention is characterized by comprising a toner comprising an external additive, a photoreceptor containing fluororesin particles in its surface layer, and a cleaning blade for cleaning a surface of the photoreceptor, wherein a primary particle diameter of the fluororesin particles is 2.6-7.5 times as large as a primary particle diameter of the external additive.

The external additive preferably has an inorganic oxide having a primary particle diameter of 40-190 nm.

The inorganic oxide is preferably fine silica particles.

The cleaning blade is preferably a urethane blade.

The urethane blade preferably has a blade thickness of 1-3 mm.

According to the invention, external additives which leave toners are neither embedded nor fixed into concave portions of a photoreceptor formed by separation of fluororesin particles, and therefore defects in a cleaning blade, filming on a photoreceptor and image defects can be prevented.

DETAILED DESCRIPTION OF THE INVENTION

Embodiments of the image forming apparatus according to the invention will be described below.

(Toner)

Figure 1:
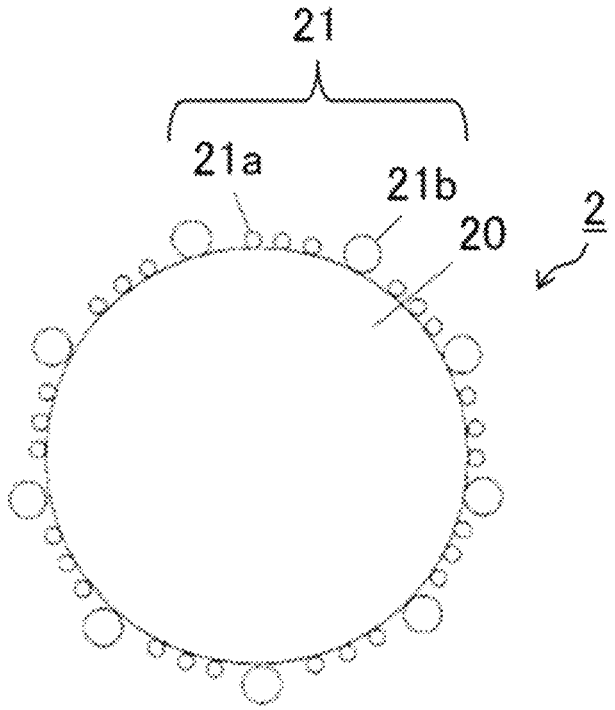
FIG. 1 is a schematic view showing the cross-section of a toner used for an embodiment of the image forming apparatus according to the invention.

FIG. 1 is a schematic view of a toner 2 used for an embodiment of the image forming apparatus according to the invention. The toner 2 used for the image forming apparatus according to the invention is a toner for electrostatic charge image development in which an external additive 21 consisting of silica particles is adherent to the surface of a toner base particle 20. The toner base particle 20 has a volume average particle diameter of 5-7 μm. The external additive 21 has an average primary particle diameter of 40-190 nm and consists of a small particle diameter external additive 21*a* and a large particle diameter external additive 21*b*.

The toner base particle 20 comprises a binder resin, a colorant, a charge-controlling agent and a release agent, etc. A layer for covering a toner is formed on the surface of the toner base particle 20. The layer for covering a toner is formed by film formation from fine resin particles.

Polyester resin or styrene-acrylic resin, etc. can be used as the binder resin. The glass transition temperature of the binder resin is preferably not less than 40° C. but not more than 60° C., while the softening temperature of the binder resin is preferably not less than 80° C. but not more than 140° C.

Organic dyes, organic pigments, etc. which are generally used in the field of toner can be used as the colorant. The colorant is added in an amount of 2-10 parts by weight based on 100 parts by weight of the binder resin.

Black colorants include, for example, carbon black or magnetite, etc.

Yellow colorants include, for example, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, etc.

Magenta colorants include, for example, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, etc.

Cyan colorants include, for example, C.I. Pigment Blue 15, C.I. Pigment Blue 15:2, C.I. Pigment Blue 15:3, C.I. Pigment Blue 16, C.I. Pigment Blue 60, etc.

Charge-controlling agents for controlling positive charge and negative charge which are used for commonly-used toners can be used as the charge-controlling agent. The charge-controlling agent is generally added in an amount of 0.5-3 parts by weight based on 100 parts by weight of the binder resin. Charge-controlling agents for controlling positive charge include, for example, nigrosine dye, quaternary ammonium salt, etc., while charge-controlling agents for controlling negative charge include azo complex dye, metal complex and metal salt of salicylic acid and its derivatives, boron compounds, etc.

Waxes which are used for commonly-used toners can be used as the release agent. The release agent is generally added in an amount of 0.5-10 parts by weight based on 100 parts by weight of the binder resin. Waxes include, for example, paraffin wax, microcrystalline wax, Fischer-Tropsch wax, polyethylene wax, polypropylene wax, carnauba wax, etc.

External additives which are generally used in the technical filed can be used as the external additive 21. The external additive 21 will be described in detail in the method for producing the toner 2.

The method for producing the toner 2 will be described below. The toner base particle 20 comprises a binder resin, a release agent and a colorant. Methods for producing toner base particles 20 include, for example, dry techniques such as a pulverization method and wet techniques such as a suspension polymerization method, an emulsification aggregation method, a dispersion polymerization method, a dissolution suspension method, a melting emulsification method. A method for producing toner base particles 20 through the pulverization method will be described below.

In the case where toner base particles 20 are produced by the pulverization method, a toner composition comprising a binder resin, a colorant and, if necessary, a release agent or a charge-controlling agent is dry-mixed by a mixer, and thereafter melt-kneaded by a kneader. A kneaded material obtained by melt-kneading is cooled and solidified, and then the solidified material is pulverized by a pulverizing machine, and thereafter treated as needed with particle size adjustment by classification, etc., to obtain toner base particles 20.

Mixers can include, for example, Henschel mixer (trade name, made by Mitsui Mining Co., Ltd.), Super mixer (trade name, made by Kawata MFG Co., Ltd.), etc.

Commonly-used kneaders such as, for example, a twin-screw extruder, a three roll mill, a Laboplast mill can be used as a kneader. More specifically, kneaders include, for example, a single- or twin-screw extruder such as TEM-100B (trade name, made by Toshiba Machine Co., Ltd.), PCM-65/87, PCM-30 (both are trade names and made by Ikegai Corporation), etc., a open roll kneader such as Kneadex (trade name, made by Mitsui Mining Co., Ltd.), etc. Among them, the open roll kneader is preferable.

Pulverizing machines include, for example, a jet pulverizing machine that employs a supersonic jet stream for pulverization, and an impact pulverizing machine that guides a solidified material to a space formed between a rotor rotated at a high speed and a stator (liner) to pulverize it.

For example, a revolving type wind-force classifying machine (rotary type wind-force classifying machine), etc. can be used as a classifying machine.

An external additive 21 is further added to the resulting toner base particles 20 having no external additive, and mixed to obtain a toner 2 as shown in FIG. 1. The addition of the external additive 21 can improve the flowability of the toner 2 and cleaning properties for residual toners on the surfaces of photoreceptors and prevent filming on photoreceptors.

External additives that are generally used in the technical field can be used as the external additive 21, including, for example, inorganic oxides such as silica, alumina, titania, zirconia, tin oxide and zinc oxide; compounds such as acrylic acid esters, methacrylic acid esters and styrene, and fine copolymer resin particles thereof, fine fluororesin particles, fine silicone resin particles; higher fatty acids such as stearic acid, and metal salts thereof; carbon black, graphite fluoride, silicon carbide, boron nitride, etc.

The external additive 21, in particular the external additive of inorganic oxide, is preferably subjected to surface treatment with a silicone resin, a silane coupling agent, etc. For example, hydrophobic fine silica particles are preferably used.

The average primary particle diameter of the external additive 21 is preferably 40-190 nm from the viewpoint of further improvement in the flowability of toners. The BET specific surface area of the external additive is preferably 20-200 $m^2/g$ from the viewpoint of giving appropriate flowability and chargeability to toners.

The amount of the external additive 21 added is preferably 0.5 parts by weight to 5 parts by weight based on 100 parts of the toner base particles 20 having no external additive. When the amount of the external additive 21 added is within the range described above, a toner can be obtained which can form a color image less likely to get discolored without damaging the chargeability of the toner 2.

(Photoreceptor)

Figure 2:
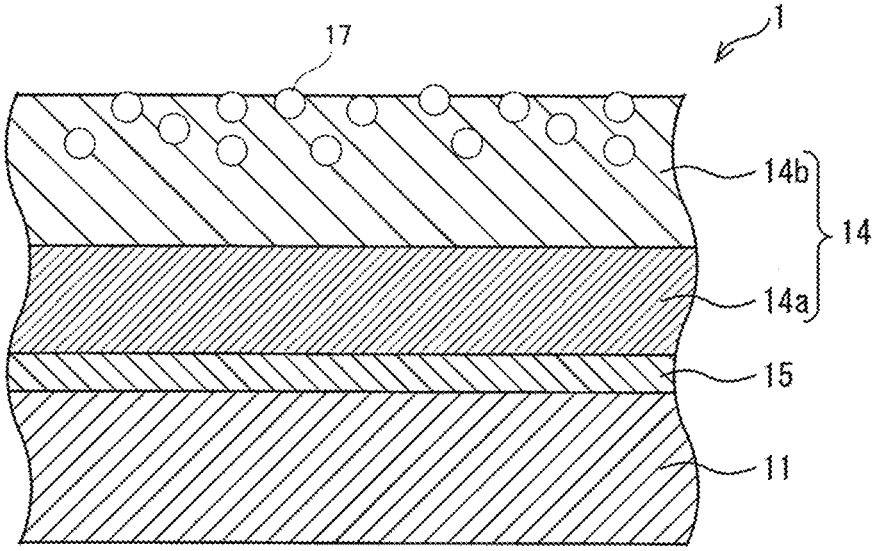
FIG. 2 is a schematic view showing the cross-section of an electrophotographic photoreceptor used for an embodiment of the image forming apparatus according to the invention.

FIG. 2 is a schematic view showing the cross-section of an electrophotographic photoreceptor used for an embodiment of the image forming apparatus according to the invention. A photoreceptor 1 according to the embodiment comprises a cylindrical conductive substrate 11 composed of a conductive material, an undercoat layer (intermediate layer) 15 formed on the outer peripheral surface of the conductive substrate 11, and a photosensitive layer 14 formed on the outer peripheral surface of the undercoat layer 15.

The photosensitive layer 14 comprise a charge generation layer 14*a* and a charge transport layer 14*b*, as shown in FIG. 2. The charge generation layer 14*a* is stacked on the outer peripheral surface of the undercoat layer 15 and contains a charge generation material. The charge transport layer 14*b* is stacked on the outer peripheral surface of the charge generation layer 14*a* and contains a charge transport material. In the example shown in FIG. 2, the charge transport layer 14*b* of layers constituting the photosensitive layer 14 corresponds to the surface layer of the photoreceptor 1. Filler particles 17 such as fluororesin particles are added to the surface layer for the purpose of improvement in wear resistance.

The conductive substrate 11 functions as an electrode of the photoreceptor 1 but also as a support member for layers disposed outside (i.e. undercoat layer 15 and photosensitive layer 14).

A conductive material constituting the conductive substrate 11 includes, for example, conductive metals such as aluminum, copper, brass, zinc, nickel, stainless steel, chromium, molybdenum, vanadium, indium, titanium, gold and platinum, or alloy materials of the conductive metals. Alternatively, conductive metals or alloy materials or metallic oxides of the conductive metals such as aluminum, tin oxide, gold, indium oxide, etc. may be used as the conductive material. A conductive material may be used which is a metal foil composed of the above conductive material laminated or deposited on the surface of a polymer material (such as polyethylene terephthalate, nylon, polyester, polyoxymethylene or polystyrene), hard paper or glass, etc. A conductive material may be used which is a layer of a conductive compound such as a conductive polymer, tin oxide, indium oxide, etc. deposited or applied on the surface of the polymer material, hard paper or glass, etc. The conductive substrate 11 is formed by processing the conductive material in a predetermined shape.

In the absence of the undercoat layer 15 between the conductive substrate 11 and the photosensitive layer 14, reduction in chargeability at minute regions can be caused due to defects of the conductive substrate 11 or photosensitive layer 14, and hence fogging of image such as black dots occurs, which can cause severe image defects.

Resin layers composed of various resin materials or alumite layers, etc. can be used for the undercoat layer 15. Resin materials constituting resin layers include resins such as polyethylene resins, polypropylene resins, polystyrene resins, acrylic resins, vinyl chloride resins, vinyl acetate resins, polyurethane resins, epoxy resins, polyester resins, melamine resins, silicone resins, polyvinyl butyral resins, polyvinylpyrrolidone resins, polyacrylamide resins and polyamide resins, and copolymer resins having at least two of repeating units constituting these resins, etc. Also, the materials include casein, gelatin, polyvinyl alcohol, cellulose, nitrocellulose and ethylcellulose, etc. Among these resins, polyamide resins are preferably used, and in particular alcohol-soluble nylon resins are preferably used. Preferable alcohol-soluble nylon resins can include, for example, so-called copolymer nylons in which 6-nylon, 6,6-nylon, 6,10-nylon, 11-nylon, 2-nylon and 12-nylon, etc. are copolymerized, and resins formed by modifying nylons chemically like N-alkoxymethyl-modified nylon and N-alkoxyethyl-modified nylon, etc.

In order to give a charge adjustment function to the undercoat layer 15, a filler is added to the undercoat layer 15. Fine metal oxide particles are applied as the filler added to the undercoat layer 15. The particles can include, for example, particles of titanium oxide, aluminum oxide, aluminum hydroxide and tin oxide, etc. The particle diameter of metal oxide is suitably not less than 0.01 μm but not more than 0.3 μm, preferably not less than 0.02 μm but not more than 0.1 μm.

The undercoat layer 15 is formed, for example, by dissolving or dispersing the resin in a suitable solvent to prepare a coating solution for an undercoat layer and applying the coating solution onto the surface of the conductive substrate 11. In the case where the undercoat layer 15 contains the oxide particles, the undercoat layer 15 can be formed, for example, by dissolving the resin in a suitable solvent to obtain a resin solution, dispersing fine metal oxide particles in the resin solution to prepare a coating solution for a undercoat layer, and applying the coating solution onto the surface of the conductive substrate 11.

Water or various organic solvents, or mixed solutions thereof can be used for a solvent of the coating solution for a undercoat layer. For example, single solvents such as water, methanol, ethanol or butanol, or mixed solutions of water and alcohols, mixed solutions of two or more alcohols, mixed solutions of acetone or dioxolan, etc. and alcohols, mixed solutions of halogen-based organic solvents such as dichloroethane, chloroform, trichloroethane or the like and alcohols, etc. can be used. Among these solvents, non-halogen-based organic solvents are preferably used out of consideration to global environment.

A method for applying a coating solution for a undercoat layer can include a spray method, a bar coating method, a roll coating method, a blade method, a ring method and a dip coating method, etc. In particular among them, the dip coating method is relatively simple and excellent in productivity and costs, and therefore it is often employed in the case of forming the undercoat layer 15.

The charge generation layer **14*a*** contains as a main component a charge generation material which generates an electrical charge through absorption of light.

Materials usable as the charge generation material include azo type pigments such as monoazo type pigments, bisazo type pigments and trisazo type pigments, indigo type pigments such as indigo and thioindigo, perylene type pigments such as perylene imide and perylene acid anhydride, polycyclic quinone type pigments such as anthraquinone and pyrene quinone, phthalocyanine type pigments such as metal phthalocyanine and metal-free phthalocyanine, organic photoconductive materials such as squalilium dyes, pyrylium salts, thiopyrylium salts, triphenylmethane type dyes.

Charge generation materials may be used in combination with sensitizing dyes such as triphenylmethane type dyes typified by Methyl Violet, Crystal Violet, Night Blue and Victoria Blue, etc., acridine dyes typified by Erythrocin, Rhodamine B, Rhodamine 3R, Acridine Orange and Flapeosine, etc., thiazine dyes typified by Methylene Blue and Methylene Green, etc., oxazine dyes typified by Capryl Blue and Meldola's Blue, etc., cyanine dyes, styryl dyes, pyrylium salt dyes or thiopyrylium salt dyes, etc.

A method for forming the charge generation layer **14*a* employs a method in which the charge generation material is vacuum-deposited on the surface of the conductive substrate 11, or a method in which the charge generation material is dispersed in a suitable solvent and then the resulting coating solution for a charge generation layer is applied onto the surface of the conductive substrate 11**, etc.

In particular, it is preferable to use a method in which a binder resin as a binder is mixed in a solvent to obtain a binder resin solution, a charge generation material is dispersed in the binder resin solution according to a conventionally-known method to prepare a coating solution for a charge generation layer, and the resulting coating solution is applied onto the surface of the conductive substrate 11. This method will be described below.

The binder Resin used for the charge generation layer **14*a*** can includes, for example, resins such as polyester resins, polystyrene resins, polyurethane resins, phenol resins, alkyd resins, melamine resins, epoxy resins, silicone resins, acrylic resins, methacrylic resins, polycarbonate resins, polyarylate resins, phenoxy resins, polyvinyl butyral resins, polyvinyl chloride resins and polyvinyl formal resins, and copolymer resins having at least two of repeating units constituting these resins, etc.

Specific examples of copolymer resins can include insulating resins such as, for example, vinyl chloride/vinyl acetate copolymer resins, vinyl chloride/vinyl acetate/maleic anhydride copolymer resins and acrylonitrile/styrene copolymer resins, etc.

For example, halogenated hydrocarbons such as dichloromethane or dichloroethane, alcohols such as methanol, ethanol, etc., ketones such as acetone, methyl ethyl ketone or cyclohexanone, esters such as ethyl acetate or butyl acetate, ethers such as tetrahydrofuran or dioxane, alkyl ethers of ethylene glycol such as 1,2-dimethoxyethane, aromatic hydrocarbons such as benzene, toluene or xylene, or aprotic polar solvents such as N,N-dimethylformamide or N,N-dimethylacetamide, etc. can be used for a solvent of a coating solution for a charge generation layer.

Charge generation materials may be subjected to previous pulverization treatment with pulverizing machines before dispersing in binder resin solutions. Pulverizing machines used for the pulverization treatment can include a ball mill, a sand mill, an attritor, a vibration mill and an ultrasonic dispersing machine, etc.

Dispersing machines used in dispersing charge generation materials in binder resin solutions can include a paint shaker, a boll mill and a sand mill, etc. In this case, suitable dispersion conditions are selected so as to prevent inclusion of impurities that is caused by the wear of members constituting containers and dispersing machines used, etc.

A method for applying a coating solution for a charge generation layer can include a spray method, a bar coating method, a roll coating method, a blade method, a ring method and a dip coating method, etc. Out of these coating methods, an optimum method can be selected in consideration of coating properties and productivity, etc. In particular among these application methods, the dip coating method is relatively simple and excellent in productivity and costs, and therefore it is often employed in the case of producing photoreceptors. In the dip coating method, a substrate is immersed in a coating bath filled with a coating solution, and then raised at a constant rare or at a rate that changes successively to form a layer on the surface of the substrate. An apparatus used for the dip coating method may be provided with a coating solution dispersing machine typified by an ultrasonic generator to stabilize dispersibility of coating solutions.

The charge transport layer 14*b* is disposed on the outer peripheral surface of the charge generation layer 14*a*. The charge transport layer 14*b* contains a charge transport material which has an ability to receive and transport electrical charges generated by a charge generation material contained in the charge generation layer 14*a*, and a binder resin which binds the charge transport material.

Charge transport materials can include enamine derivatives, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triaryimethane derivatives, phenylenediamine derivatives, stilbene derivatives and benzidine derivatives, etc.

Resins comprising well known polycarbonates in the technical field as a main component are preferably selected for the binder resin constituting the charge transport layer 14*b*, because of excellent transparency and printing durability, etc. Other resins as the second component can include, for example, vinyl polymer resins such as polymethy methacrylate resins, polystyrene resins, polyvinyl chloride resins, etc. or copolymer resins having at least two of repeating units constituting them, or polyester resins, polyester carbonate resins, polysulphone resins, phenoxy resins, epoxy resins, silicone resins, polyarylate resins, polyamide resins, polyether resins, polyurethane resins, polyacrylamide resins and phenol resins, etc.

Also, thermosetting resins in which these resins are cross-linked partially are included. These resins may be used alone or in a mixture of two or more. The main component means that weight % of polycarbonate resins accounts for the highest percentage, preferably 50-90% by weight, of total binder resins constituting the charge transport layer. The second component can be used within the range of 10-50% by weight based on total weight of binder resins constituting the charge transport layer 14*b*.

The proportion of charge transport materials to binder resins in the charge transport layer is preferably in a ratio by weight of 10/10 to 10/18.

When the charge transport layer 14*b* is the surface layer, filler particles 17 are added for the purpose of improving wear resistance, etc. Cross-linked fluororesin particles having a primary particle diameter of 0.15-0.5 μam, in particular polytetrafluoroethylene particles (PTFE particles) are preferably used as filler particles 17. Preferable specific production methods are methods described in Japanese Patent No. 3789649.

In the image forming apparatus according to the invention, fluororesin particles are contained in the surface layer of a photoreceptor, and the primary particle diameter of the fluororesin particles is required to be 2.6-7.5 times as large as the primary particle diameter of the external additive. When the ratio of fluororesin particles' primary particle diameter/external additive's primary particle diameter is 2.6-7.5, even if external additives which leave toners fill concave portions in the surface of a photoreceptor formed by separation of fluororesin particles, adhesion of external additives to concave portions in the surface of the photoreceptor is weak and external additives can easily be removed by a cleaning blade, and therefore defects on the cleaning blade, filming on the photoreceptor and image defects can be prevented.

In PTFE particles, the amount of PTFE particles added is preferably set so as to be the following PTFE concentration of not less than 1% by weight but not more than 30% by weight. More preferably, the amount of PTFE particles added is set so as to be the following PTFE concentration of not less than 5% by weight but not more than 15% by weight.

The PTFE concentration used herein is a weight percentage of PTFE based on total weight of PTFE and solid components other than PTFE in a layer added with PTFE. That is, it is a value calculated by dividing the amount (weight) of PTFE added by total weight of total solid components in a layer added with PTFE and multiplying the divided value by 100. When PTFE is added to the charge transport layer 14*b* as in the embodiment, solid components other than PTFE are charge transport materials and binder resins and antioxidants, etc.

When the PTFE concentration is not less than 1% by weight but not more than 30% by weight (more preferably not less than 5% by weight but not more than 15% by weight), there are advantages that simultaneously establish excellent printing durability and stabilization of electrical properties for photoreceptors. When the PTFE concentration is less than 1% by weight, there is no improvement effect of addition of PTFE on wear resistance, while when the PTFE concentration is more than 30% by weight, electrical properties of photoreceptors are significantly deteriorated, and therefore it is unable to withstand practical use.

Commonly-used methods employing a ball mill, a sand mill, an attritor, a vibration mill, an ultrasonic dispersing machine or a paint shaker, etc. can be used as methods for dispersing filler particles (PTFE particles), as in the case of oxide particles to be added to undercoat layers. More stable coating dispersions can be prepared by means of dispersing machines of media-less type that employ a very strong shear force generated by passing dispersions through micro space under extreme pressure.

The charge transport layer 14*b* may be added, if necessary, with various additives. That is, a plasticizer or a leveling agent, etc. may be added to the charge transport layer 14*b* for improvements in film-forming properties, flexibility or surface smoothness. Plasticizers can include, for example, dibasic acid esters such as phthalates, etc., fatty acid esters, phosphates, chlorinated paraffins and epoxy-type plasticizers, etc. Leveling agents can include, for example, silicone-based leveling agents, etc.

The charge transport layer 14*b* is formed, for example, by dissolving or dispersing a charge transport material, a binder resin, the filler particles 17 and/or the additives to a suitable solvent to prepare a coating solution for a charge transport layer and applying the resulting coating solution onto the outer peripheral surface of the charge generation layer 14*a*, as in the case of forming the charge generation layer 14*a* through coating.

Solvents of coating solutions for charge transport layers can include, for example, aromatic hydrocarbons such as benzene, toluene, xylene and monochlorobenzene, halogenated hydrocarbons such as dichloromethane and dichloroethane, ethers such as tetrahydrofuran, dioxane and dimethoxymethylether, and aprotic polar solvents such as N,N-dimethylformamide, etc. These solvents may be used alone or in a mixture of two or more.

Methods for applying coating solutions for charge generation layers can include spray methods, bar coating methods, roll coating methods, blade methods, ring methods and dip coating methods, etc. In particular among these coating methods, the dip coating method is excellent in various respects as described above, and therefore it is often employed in the case of forming the charge transport layer 14*b*.

(Image Forming Apparatus)

Figure 3:
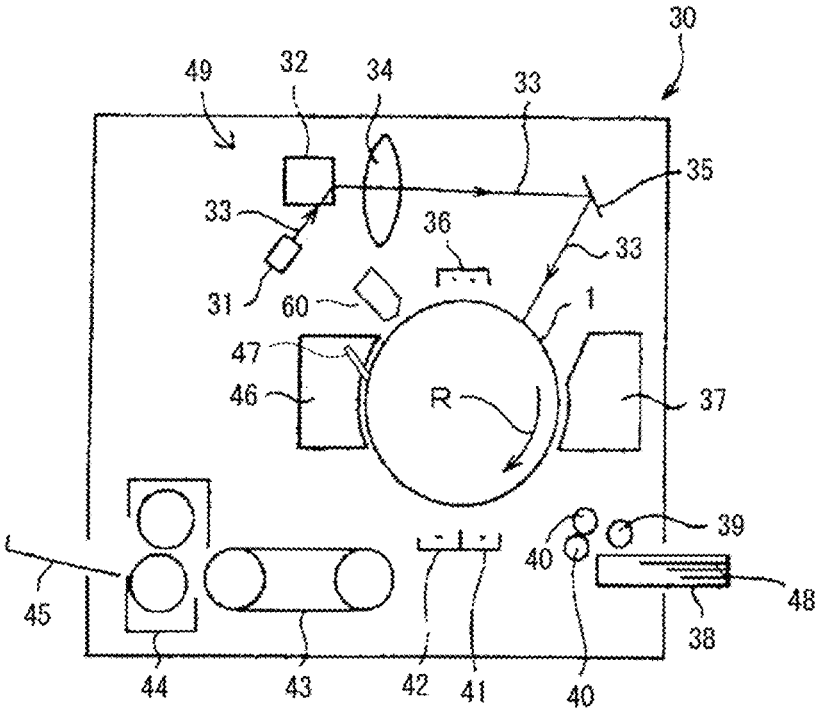
FIG. 3 is a schematic view showing the inside of an embodiment of the image forming apparatus according to the invention.

Next, an electrophotographic image forming apparatus comprising the photoreceptor 1 of the embodiment will be described below. FIG. 3 is a schematic view showing the inside of an embodiment of the image forming apparatus according to the invention.

The image forming apparatus 30 shown in FIG. 3 is a laser printer. The image forming apparatus 30 comprises a photoreceptor 1, a semiconductor laser 31, a rotating polygon mirror 32, an imaging lens 34, a mirror 35, a corona charger 36, a developing unit 37, a transfer paper cassette 38, a paper feed roller 39, a resist roller 40, a transfer charger 41, an isolation charger 42, a conveyer belt 43, a fixing unit 44, a discharge tray 45 and a cleaner 46.

The photoreceptor 1 is mounted on the image forming apparatus 30 so that it can be rotated in the direction of the arrow R by a driving means not shown in the figure. A laser beam 33 emitted from the semiconductor laser 31 is used to scan by means of the rotating polygon mirror 32. The imaging lens 34 has f-θ characters, and the laser beam 33 is reflected by the mirror 35 to form an image on the surface of the photoreceptor 1. The photoreceptor 1 is scanned by the laser beam 33 in the above manner while rotating the photoreceptor 1 to form an image, thereby forming an electrostatic latent image corresponding to image information on the surface of the photoreceptor 1.

The corona charger 36, developing unit 37, transfer charger 41, isolation charger 42 and cleaner 46 are arranged in this order towards the downstream side from upstream side in the rotation direction of the photoreceptor 1 as shown by the arrow R. The corona charger 36 is disposed on the upstream side of the imaging point of the laser beam 33 in the rotation direction of the photoreceptor 1 to charge the surface of the photoreceptor 1 uniformly. When the surface of the photoreceptor 1 charged uniformly is irradiated (exposed) by the laser beam 33, a difference in charge amount is made between the irradiated portion and other portions, which results in the formation of the above electrostatic latent image.

The developing unit 37 is disposed on the downstream side of the imaging point of the laser beam 33 in the rotation direction of the photoreceptor 1, and supplies toners to the electrostatic latent image formed on the surface of the photoreceptor 1 to develop the electrostatic latent image into a toner image. Transfer papers 48 housed in the transfer paper cassette 38 are taken out one by one by the paper feed roller 39 and are each provided to the transfer charger 41 by the resist roller 40. The toner image is transferred to the transfer paper 48 by the transfer charger 41. The isolation charger 42 removes charges from the transfer paper with the toner image transferred thereon to separate the paper from the photoreceptor 1.

The transfer paper 48 separated from the photoreceptor 1 is conveyed to the fixing device 44 by the conveyer belt 43 and the toner image is fixed by the fixing device 44 to form an image, and the paper is discharged to the paper discharge tray 45. After the transfer paper 48 is separated by the isolation charger 42, the photoreceptor 1 that continues to rotate is cleaned by a cleaning blade 47 provided in the cleaner 46 to remove residual toners and foreign materials such as paper dust on its surface. Charges are removed form the cleaned portion of the photoreceptor 1 by a charge-removing lamp 60. A series of image formation processes like this is repeated by rotating the photoreceptor 1.

The cleaning blade 47 provided in the cleaner 46 preferably employs a urethane blade having a thickness of 1-3 mm. The cleaning blade 47 can maintain an appropriate attitude for the cleaning blade and hence maintain good cleaning properties.

EXAMPLES

As shown in Table 1, toners 2 added with external additives having different average primary particle diameters and photoreceptors 1 added with fluororesins having different average primary particle diameters were prepared and used in image forming apparatuses 30, and cleaning properties were evaluated depending on average primary particle diameter ratios of fluororesin particles of photoreceptors 1 to external additives of toners 2. There has been found that there is an optimum range of average primary particle diameter ratios of fluororesin particles of photoreceptors 1 to external additives of toners 2 to make cleaning properties good.

TABLE 1

| | Toner | | Photoreceptor | | | |
|---|---|---|---|---|---|---|
| | Large particle diameter external additive (Fine silica particles) | Primary particle diameter (μm) | Fine fluororesin particles (PTFE particles) | Primary particle diameter (μm) | Particle diamter ratio (PTFE/silica) | Cleaning properties |
| Example 1 | TG-C1904 made by Carbot Corporation | 0.12 | Lubron L2 made by Daikin Industries, Ltd. | 0.3 | 2.61 | G |
| Example 2 | AKP50 made by Sumitomo Chemical Co., Ltd. | 0.19 | Lubron L5 made by Daikin Industries, Ltd. | 0.5 | 2.63 | G |

TABLE 1-continued

| | Toner | | Photoreceptor | | | |
|---|---|---|---|---|---|---|
| | Large particle diameter external additive (Fine silica particles) | Primary particle diameter (μm) | Fine fluororesin particles (PTFE particles) | Primary particle diameter (μm) | Particle diamter ratio (PTFE/silica) | Cleaning properties |
| Example 3 | KE-P10 made by Nippon Shokubai Co., Ltd. | 0.11 | Lubron L2 made by Daikin Industries, Ltd. | 0.3 | 2.73 | G |
| Example 4 | TG-C1904 made by Carbot Corporation | 0.12 | Lubron L5F made by Daikin Industries, Ltd. | 0.4 | 3.33 | G |
| Example 5 | KE-P10 made by Nippon Shokubai Co., Ltd. | 0.11 | Lubron L5F made by Daikin Industries, Ltd. | 0.4 | 3.64 | G |
| Example 6 | TG-C1904 made by Carbot Corporation | 0.12 | Lubron L5 made by Daikin Industries, Ltd. | 0.5 | 4.17 | G |
| Example 7 | KE-P10 made by Nippon Shokubai Co., Ltd. | 0.11 | Lubron L5 made by Daikin Industries, Ltd. | 0.5 | 4.55 | G |
| Example 8 | OX50 made by Nippon Aerosil Co., Ltd. | 0.04 | Lubron L2 made by Daikin Industries, Ltd. | 0.3 | 7.50 | G |
| Comparative Example 1 | PL-20 made by Fuso Chemical Co., Ltd. | 0.22 | Lubron L5 made by Daikin Industries, Ltd. | 0.5 | 2.27 | B |
| Comparative Example 2 | OX50 made by Nippon Aerosil Co., Ltd. | 0.04 | Lubron L5F made by Daikin Industries, Ltd. | 0.4 | 10.00 | B |

The invention will be more particularly described below by the following Examples and Comparative Examples. In what follows, the expressions of "part(s)" and "%" refer to "part(s) by mass" and "% by mass", respectively, if not otherwise specified. First, measurement methods of various physical properties will be described.

<Measurement Methods of Various Physical Properties>

(Volume Average Particle Diameter and Coefficient of Variance of Toners)

20 mg of a sample and 1 ml of sodium alkyl ether sulfate were added to 50 ml of an electrolysis solution (trade name: ISOTON-II, made by Beckman Coulter, Inc.), and were subjected to a dispersion treatment with an ultrasonic distributor (trade name: Desktop Two-Frequency Ultrasonic Cleaner VS-D100, made by AS ONE Corporation) for 3 minutes at a frequency of 20 kHz, thereby preparing a specimen for measurement. The specimen was measured using a particle size distribution-measuring apparatus (trade name: Multisizer 3, made by Beckman Coulter, Inc.) under conditions that an aperture diameter was 100 μm and the number of particles measured was 50000 counts. A volume average particle diameter and a standard deviation in volume particle size distribution were determined on the basis of the volume particle size distribution of the specimen particles. The coefficient of variation (CV value, %) was calculated by the following equation:

CV value (%)=(Standard deviation in volume particle size distribution/Volume average particle diameter)×100

(Average Particle Diameter and Particle Size Distribution of Fine Resin Particles)

100 images of fine resin particles were taken with a scanning electron microscope (trade name: S-4300SE/N, made by Hitachi High-Technologies Corporation) at a magnification of 50000 times while changing the perspective, and each Martin's diameter of fine resin particles (the length of a line segment that divides the area of a particle into two equal parts, obtained by measuring a dimension in a constant direction) was measured by image analysis. A particle size distribution was obtained by calculating frequency ratios at any particle diameters from the resulting measurement values. In this particle size distribution, a particle diameter at a number cumulative ratio of 50% was set to be the average primary particle diameter of fine resin particles.

(Volume Average Particle Diameter of Fine Resin Particles)

A specimen for measurement in which fine resin particles were dispersed (dispersion medium: water (refractive index of 1.33), dispersoid: refractive index of 1.49) was injected into a laser diffraction scattering particle size distribution-measuring apparatus (Microtrac MT3000, made by Nikkiso Co., Ltd.), and measurement was carried out. A volume average particle diameter was determined on the basis of the volume particle size distribution of the specimen for measurement.

(Glass Transition Point of Resin)

1 g of a sample was heated at a temperature rising rate of 10° C./minute using a differential scanning calorimetry (trade name: DSC220, made by Seiko Electronics industrial Co., Ltd.) according to Japanese Industrial Standard (JIS) K7121-1987 to measure a DSC curve. In the resulting DSC curve, a temperature at an intersection point between a straight line obtained by extending a base line at a high-temperature side of the endothermic peak corresponding to glass transition toward a low-temperature side and a tangent line drawn at a point that reached the largest gradient in the curve from the starting part to the vertex of the peak was set to be the glass transition point (TG).

(Softening Temperature of Resin)

1 g of a sample was heated at a temperature rising rate of 6° C./minute using a rheological characteristic evaluation apparatus (trade name: Flow Tester CFT-100C, made by Shimadzu Corporation), and was subjected to a load of 20 kgf/cm$^2$ ($9.8\times10^5$ Pa). A temperature at which the sample began to flow out of a die (nozzle bore diameter of 1 mm and length of 1 mm) was set to be the softening temperature.

Next, production methods of toners and photoreceptors will be described.

<Production Method of Toner>

(Toner)

100 parts by weight of a styrene-butyl acrylate resin (glass transition point of 45° C., softening temperature of 95° C.), 10 parts by weight of carbon black (MA-100, made by Mitsubishi Chemical Corporation), 2 parts by weight of a charge controlling agent (TRH, made by Hodogaya Chemical Co., Ltd.) and 4 parts by weight of a polyethylene wax (PW 725, made by Toyo ADL Corporation, melting point of 106° C.) were mixed and dispersed for 3 minutes with a Henschel mixer and thereafter were melt-kneaded and dispersed with a twin-screw extruder (trade name: PCM-30, made by Ikegai Corporation).

The twin-screw extruder was operated under conditions where a cylinder setting temperature was 110° C., the number of barrel revolutions was 300 rpm and a raw-material supply rate was 20 kg/hour. The resulting toner kneaded material was cooled by a cooling belt and thereafter was coarsely crushed by a speed mill having a screen of ϕ2 mm. The coarsely-crushed material was finely pulverized by a jet-type pulverizing machine (trade name: IDS-2, made by Nippon Pneumatic Mfg. Co., Ltd.) and further subjected to classification using an Elbow-Jet classifying machine (trade name, made by Nittetsu Mining Co., Ltd.) to obtain a toner (volume average particle diameter of 6.4 μm, coefficient of variation of 21).

(Fine Resin Particle)

168 parts by weight of a deionization water was charged into a reaction container provided with a heating and stirring device, a thermometer, a nitrogen gas-introducing pipe and a cooling pipe, and was raised to 80° C. A monomer mixture solution consisting of 252 parts by weight of a deionization water, 1 part by weight of polyoxyethylene alkyl ether, 75 parts by weight of styrene and 25 parts by weight of n-butyl acrylate and a aqueous initiator solution consisting of 1 part by weight of ammonium peroxodisulfate, 0.2 parts by weight of n-dodecyl mercaptan and 62 parts by weight of a deionization water were simultaneously dropped thereto over 110 minutes and further stirred for 60 minutes, and thereafter the reaction was terminated. The resulting latex was pulverized while hot-air drying by means of a spray dryer (trade name: Micro Mist Dryer MDL-050 Model, made by Fujisaki Electric Co., Ltd.) to obtain substantially-monodisperse, fine resin particles having a glass transition point of 60° C., a softening temperature of 95° C. and a particle diameter of 0.15 μm.

(Toner 2)

100 parts by weight of the toner and 10 parts by weight of the fine resin particles were charged into a hybridization system (trade name: NHS-1 Model, made by Nara Machinery Co., Ltd.) and mixed at a revolution speed of 8000 rpm for 7 minutes and hence film formation of fine resin particles took place on the surface of the toner to obtain a capsule toner particle having no external additive.

100 parts by weight of the capsule toner particles having no external additive, 0.5 parts by weight of the large particle diameter external additive shown in Table 1 (TG-C1904 made by Carbot Corporation, fine silica particles having a primary particle diameter of 0.12 μm) and 2 parts by weight of hydrophobic, fine silica particles having an average primary particle diameter of 7 nm (trade name: Fumed Silica R976, made by Nippon Aerosil Co., Ltd.) were charged into a Henschel mixer (trade name: FM20C, made by Mitsui Mining Co., Ltd.) in which the peripheral speed in the outermost peripheral of the tip section of a stirring blade was set to be 40 m/s, and then mixed with stirring for one minute to obtain a toner 2 (volume average particle diameter of 6.5 μm, coefficient of variation of 23).

<Production Method of Photoreceptor>

(Undercoat Layer)

3 parts by weight of titanium oxide (trade name: Taibake TTO-D-1, made by Ishihara Sangyo Kaisha Ltd.) and 2 parts by weight of a commercially-available polyamide resin (trade name: Amiran CM8000, made by Toray Industries, Inc.) were mixed with 25 parts by weight of methyl alcohol, and the mixture was subjected to a dispersing treatment using a paint shaker for 8 hours to prepare 3 kg of a coating solution for forming an undercoat layer (the mixture after the dispersing treatment was the coating solution). The coating solution was applied onto a conductive substrate by a dip coating method. In particular, the resulting coating solution filled a bath for coating, and a drum-type aluminum substrate having a diameter of 30 mm and a length of 357 mm as the conductive substrate was immersed in the coating solution and then raised to form an undercoat layer (intermediate layer) having a film thickness of 1 μm.

(Charge Generation Layer)

Titanyl phthalocyanine that showed an X-ray diffraction spectrum having a main peak at a Bragg angle (2θ±0.2°) of 27.3° to X-ray of CuKα: 1.541 Å was used as a charge generation material, and a butyral resin (trade name: Esrec BM-2, made by Sekisui Chemical Co., Ltd.) was used as a binder resin. 1 part by weight of the charge generation material and 1 part by weight of the binder resin were mixed with 98 parts by weight of methyl ethyl ketone, and the mixture was subjected to a dispersing treatment using a paint shaker for 8 hours to prepare 3 liters of a coating solution for forming a charge generation layer (the mixture after the dispersing treatment was the coating solution). The coating solution for charge generation layer formation was applied onto the surface of the undercoat layer by a dip coating method as in the case of undercoat layer formation. That is, the resulting coating solution for charge generation layer formation filled a bath for coating, and the drum-type substrate in which the undercoat layer was formed was immersed in the coating solution and then raised and naturally dried to form a charge generation layer having a film thickness of 0.3 μm.

(Charge Transport Layer)

A substance (T2269, made by Tokyo Chemical Industry Co., Ltd.) represented by the following formula:

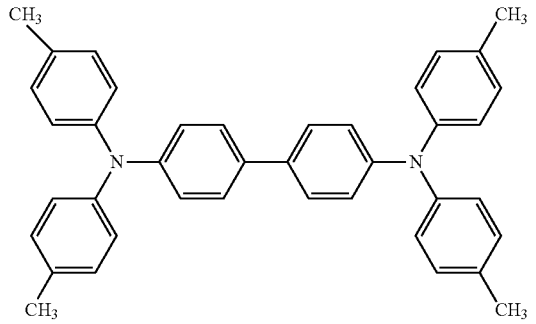

was used as a charge transport material. The substance of the formula is N,N,N',N'-tetrakis(4-methylphenyl)benzidine.

100 parts by weight of the charge transport material, 180 parts by weight of a polycarbonate resin (TS2050 made by Teijin Chemicals Ltd.) and 100 parts by weight of fluororesin particles having a primary particle diameter of 0.3 μm, Lubron L2 made by Daikin Industries, Ltd., as filler particles 17 were mixed with 665 parts by weight of tetrahydrofuran as a solvent to prepare a suspension with a solid component of 21% by weight. Thereafter, the suspension was subjected to a dispersing treatment by carrying out a five-pass operation using a wet-type emulsification/dispersion apparatus (Microfluidizer M-110P made by Powrex Corporation) under a condition of a setting pressure of 100 MPa. Accordingly, 3 kg of a coating solution for forming a charge transport layer was prepared (the solution treated with dispersing was the coating solution).

The coating solution for charge transport layer formation was applied onto the surface of the charge generation layer by a dip coating method. That is, the resulting coating solution for charge transport layer formation filled a bath for coating, and the drum-type substrate in which the charge generation layer was formed was immersed in the coating solution and then raised and dried at 120° C. for one hour to form a charge transport layer having a film thickness of 28 μm. The photoreceptor having the structure shown in FIG. 2 was prepared in this manner.

Example 1

The toner 2 added with fine silica particles having a primary particle diameter of 0.12 μm, TG-C1904 made by Carbot Corporation, as the external additive 21, and the photoreceptor 1 added with fluororesin particles having a primary particle diameter of 0.3 μm, Lubron L2 made by Daikin Industries, Ltd., as the filler particles 17 were used so as to have an average primary particle diameter ratio of fluororesin/external additive of 2.61.

Example 2

The toner 2 added with fine silica particles having a primary particle diameter of 0.19 μm, AKP50 made by Sumitomo Chemical Co., Ltd., as the external additive 21, and the photoreceptor 1 added with fluororesin particles having a primary particle diameter of 0.5 μm, Lubron L5 made by Daikin Industries, Ltd., as the filler particles 17 were used so as to have an average primary particle diameter ratio of fluororesin/external additive of 2.63.

Example 3

The toner 2 added with fine silica particles having a primary particle diameter of 0.11 μm, KE-P10 made by Nippon Shokubai Co., Ltd., as the external additive 21, and the photoreceptor 1 added with fluororesin particles having a primary particle diameter of 0.3 μm, Lubron L2 made by Daikin Industries, Ltd., as the filler particles 17 were used so as to have an average primary particle diameter ratio of fluororesin/external additive of 2.73.

Example 4

The toner 2 added with fine silica particles having a primary particle diameter of 0.12 μm, TG-C1904 made by Carbot Corporation, as the external additive 21, and the photoreceptor 1 added with fluororesin particles having a primary particle diameter of 0.4 μm, Lubron L5F made by Daikin Industries, Ltd., as the filler particles 17 were used so as to have an average primary particle diameter ratio of fluororesin/external additive of 3.33.

Example 5

The toner 2 added with fine silica particles having a primary particle diameter of 0.11 μm, KE-P10 made by Nippon Shokubai Co., Ltd., as the external additive 21, and the photoreceptor 1 added with fluororesin particles having a primary particle diameter of 0.4 μm, Lubron L5F made by Daikin Industries, Ltd., as the filler particles 17 were used so as to have an average primary particle diameter ratio of fluororesin/external additive of 3.64.

Example 6

The toner 2 added with fine silica particles having a primary particle diameter of 0.12 μm, TG-C1904 made by Carbot Corporation, as the external additive 21, and the photoreceptor 1 added with fluororesin particles having a primary particle diameter of 0.5 μm, Lubron L5 made by Daikin Industries, Ltd., as the filler particles 17 were used so as to have an average primary particle diameter ratio of fluororesin/external additive of 4.17.

Example 7

The toner 2 added with fine silica particles having a primary particle diameter of 0.11 μm, KE-P10 made by Nippon Shokubai Co., Ltd., as the external additive 21, and the photoreceptor 1 added with fluororesin particles having a primary particle diameter of 0.5 μm, Lubron L5 made by Daikin Industries, Ltd., as the filler particles 17 were used so as to have an average primary particle diameter ratio of fluororesin/external additive of 4.55.

Example 8

The toner 2 added with fine silica particles having a primary particle diameter of 0.04 μm, OX50 made by Nippon Aerosil Co., Ltd., as the external additive 21, and the photoreceptor 1 added with fluororesin particles having a primary particle diameter of 0.3 μm, Lubron L2 made by Daikin Industries, Ltd., as the filler particles 17 were used so as to have an average primary particle diameter ratio of fluororesin/external additive of 7.5.

Comparative Example 1

The toner 2 added with fine silica particles having a primary particle diameter of 0.22 μm, PL-20 made by Fuso Chemical Co., Ltd., as the external additive 21, and the photoreceptor 1 added with fluororesin particles having a primary particle diameter of 0.5 μm, Lubron L5 made by Daikin Industries, Ltd., as the filler particles 17 were used so as to have an average primary particle diameter ratio of fluororesin/external additive of 2.27.

Comparative Example 2

The toner 2 added with fine silica particles having a primary particle diameter of 0.04 μm, OX50 made by Nippon Aerosil Co., Ltd., as the external additive 21, and the photoreceptor 1 added with fluororesin particles having a primary particle diameter of 0.4 μm, Lubron L5F made by Daikin Industries, Ltd., as the filler particles 17 were used so as to have an average primary particle diameter ratio of fluororesin/external additive of 10.00.

(Evaluation Method of Cleaning Properties)

With respect to the evaluation method of cleaning properties, they were set to a copying machine (trade name: MX-M503N, made by Sharp Corporation, black and white printing speed of 500 ppm, cleaning blade: urethane blade of 2 mm in thickness) and an A4 size text image of 5% in coverage rate was printed on 100000 sheets under an ordinary temperature and a normal humidity. After printing, the images and the surface of the photoreceptor were visually checked. In the visual check, there was previously checked that a fine toner line of 1 mm in width, 5 mm in length and 0.5 in image density (ID) could be observed.

G (good): Neither image defects due to cleaning failure nor filming on the photoreceptor surface is visually observable.

NB (not bad): Either image defects due to cleaning failure or filming on the photoreceptor surface is visually observable.

B (bad): Both image defects due to cleaning failure and filming on the photoreceptor surface are visually observable.

The evaluation results of cleaning properties are shown in Table 1. As seen in Examples 1-8, when the average primary particle diameter ratio of fluororesin/external additive is 2.6-7.5, even if external additives fill concave portions in the surface of a photoreceptor formed by separation of fluororesin particles, the adhesion of external additives to concave portions in the surface of the photoreceptor is weak and external additives can easily be removed by a cleaning blade. Therefore, image defects due to cleaning failure and filming on the photoreceptor surface were not observed in the images and the surface of the photoreceptor after printing on 100000 sheets, which resulted in good cleaning properties.

Figure 4:
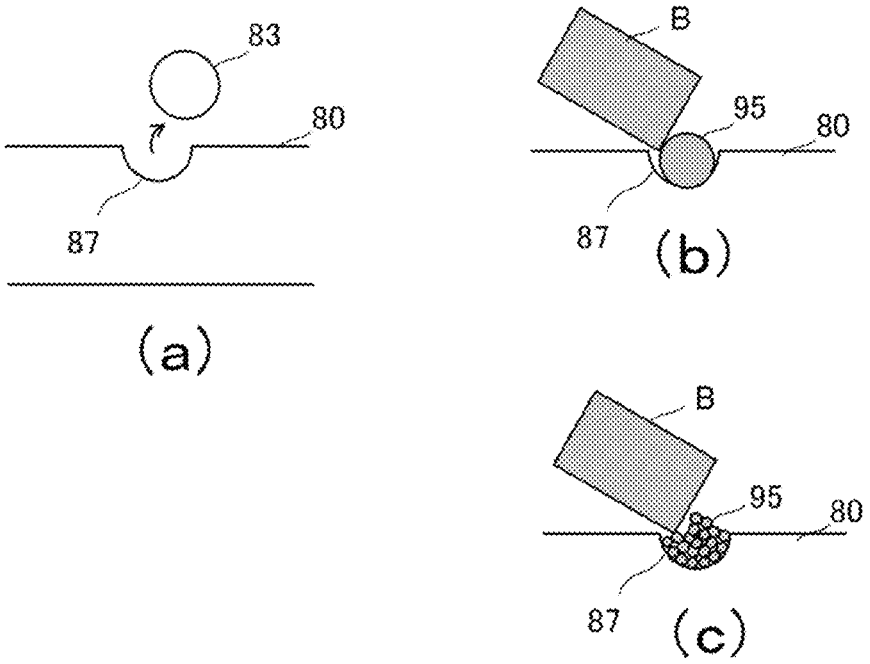
FIG. 4 is a schematic view for illustrating a problem of conventional arts.

In Comparative Example 1, the average primary particle diameter ratio of fluororesin/external additive is less than 2.6, so that the shape of the external additive can approach the concave portion of the photoreceptor surface as shown in FIG. 4(*b*). Thus, the adhesion of the external additive to the concave portion is strong and the external additive cannot be removed. Therefore, both image defects due to cleaning failure and filming on the photoreceptor surface were observed. In Comparative Example 2, the average primary particle diameter ratio of fluororesin/external additive is more than 7.5, so that external additives can agglomerate in the concave portion of the photoreceptor surface as shown in FIG. 4(*c*). Thus, the adhesion of the external additives to the concave portion is strong and the external additives cannot be removed. Therefore, both image defects due to cleaning failure and filming on the photoreceptor surface were observed.

What is claimed is:

1. An image forming apparatus comprising:

a toner comprising an external additive, wherein the external additive has an inorganic oxide having a primary particle diameter of 40-190 nm, a photoreceptor containing fluororesin particles in its surface layer, and a cleaning blade for cleaning a surface of the photoreceptor, wherein a primary particle diameter of the fluororesin particles is 2.6-7.5 times as large as a primary particle diameter of the external additive.

2. The image forming apparatus according to claim 1, wherein the inorganic oxide is fine silica particles.

3. The image forming apparatus according to claim 1, wherein the cleaning blade is a urethane blade.

4. The image forming apparatus according to claim 3, wherein the urethane blade has a blade thickness of 1-3 mm.

* * * * *